United States Patent [19]

Oldani et al.

[11] Patent Number: 4,938,191

[45] Date of Patent: Jul. 3, 1990

[54] INDUCTION DEVICE FOR MULTI-CYLINDER INTERNAL COMBUSTION ENGINE

[75] Inventors: Emilio Oldani, Cerro Maggiore; Riccardo Rosa, Milan; Sergio Truzzi, Cislano, all of Italy

[73] Assignee: Alfa Lancia Industriale S.p.A., Arese, Italy

[21] Appl. No.: 282,494

[22] Filed: Dec. 12, 1988

[30] Foreign Application Priority Data

Dec. 18, 1987 [IT] Italy ..... 23102A/87

[51] Int. Cl.[5] ..... F02B 15/00

[52] U.S. Cl. ..... 123/432; 123/308

[58] Field of Search ..... 123/432, 308

[56] References Cited

U.S. PATENT DOCUMENTS 4,300,504 11/1981 Tezuka ..... 123/432
4,625,687 12/1986 Hatamura ..... 123/432
4,660,530 4/1987 Sugiyama et al. ..... 123/432
4,669,434 6/1987 Okumura et al. ..... 123/432
4,779,594 10/1988 Oda et al. ..... 123/432

FOREIGN PATENT DOCUMENTS 3511382 10/1985 Fed. Rep. of Germany .
1469325 2/1967 France .
1511586 2/1968 France .

*Primary Examiner*—E. Rollins Cross
*Attorney, Agent, or Firm*—Charles E. Brown; Charles A. Brown

[57] ABSTRACT

In a multi-cylinder engine, equipped with at least two induction valves per cylinder, with one of said valves having a narrower induction and crossing stroke, and with another of said at least two valves having a wider induction and crossing stroke, and with a choke valve per each cylinder, the invention provides for a fuel injector to be installed substantially in correspondence of the induction valve having the narrower induction stroke and crossing.

4 Claims, 2 Drawing Sheets

INDUCTION DEVICE FOR MULTI-CYLINDER INTERNAL COMBUSTION ENGINE

The present invention relates to an induction device for a multi-cylinder internal combustion engine, which is equipped with a plurality of induction valves, and with at least one exhaust valve per each cylinder, in particular with two induction valves per each cylinder, and which is equipped with drive means for said valves, wherein said induction device comprises individual induction manifolds, one manifold per each cylinder, and with at least two induction ducts branching off from each individual manifold, and leading to the corresponding cylinder through the above said induction valves, and wherein the two induction valves belonging to each cylinder are driven with lift laws respectively optimized for low revolution speed running and for high revolution speed running of the engine.

The engines equipped with a plurality of induction valves per each cylinder, and, possibly, with more than one exhaust valves, have, as compared to the engines with only two valves per cylinder, a larger actual surface area of passage through the valves; this fact favours the exchange of the gases inside the combustion chamber, because a larger amount of air, and consequently, of gasoline, can be introduced, and a larger amount of flue gases can be exhausted, during a time unit.

From the above, a better filling of the cylinders, and a higher volumetric efficiency derives, with an increase in the specific power of the engine.

However, in these engines too, it may happen that a crossing of the induction and exhaust valves, optimized in order to take advantage, for filling purposes, of inertial phenomena and resonance waves, at determined revolution speeds, can result inadequate under other operating conditions, and, in particular, at low revolution speeds, because a portion of fresh mixture may go, unburnt, directly to the exhaust port, or a portion of the exhaust gases can flow back to the induction port, according to whether, during the crossing, between the induction port and the exhaust port, either a positive or a negative pressure difference is established.

From such an occurrence an irregular combustion, a larger fuel consumption and an increase of polluting substances in the exhaust gases results.

In order to improve the operation of these engines, in particular under low load conditions, it was proposed to drive the two induction valves by means of two different cams, with one of said cams being driven according to a lift law optimized for !low revolution speeds, and the other being operated according to a lift law optimized for high revolution speeds, as it results from French Patent No. 1,511,586.

This patent also provides for a respective choke valve to be installed inside each induction duct, with one of said choke valves being operated by the accelerator pedal, and the other being operated by a suitable actuator, in such a way that it may remain closed under low revolution speed conditions.

By such an arrangement, the negative effects of the crossing at low revolution speeds is minimized, because each cylinder is fed through one induction duct and one induction valve only, which is precisely characterized for low revolution speed operation conditions.

However, such an arrangement is rather complex and expensive.

The main purpose of the present invention is a simpler and cheaper solution, featuring an as satisfactory performance.

In particular, the present invention aims at achieving a high torque, together with reduced fuel consumptions and minimum emissions of polluting substances, when the engine operates at low speeds, and at increasing the peak power at high revolution speeds.

According to the invention, in an engine of the initially described type, a respective choke valve has been installed inside each induction manifold, according to a solution per-se known, in particular for engines equipped with two valves per cylinder, and furthermore at least one fuel injector has been installed inside each individual induction manifold, downstream the respective choke valve, in an off-centre position relatively to the longitudinal axis of the same manifold, and shifted towards the side of the induction duct equipped with the induction valve having the lift law optimized for the low revolution speed operating conditions.

By installing a choke valve inside each induction manifold, a higher freedom is reached in the selection of the timings of the valves, above all of the crossings, because possible refluxes of exhaust gases to the induction port of a cylinder, possible under low-load conditions, do not affect the fuel feed to the other cylinders.

With the off-centre positioning of the fuel injectors, through the induction valve having a narrower opening stroke and a minimum crossing relatively to the corresponding exhaust valve, air enters, which is strongly carburetted by all, or nearly all, the fuel delivered by the injector; whilst through the induction valve having a wider opening stroke and a wide crossing relatively to the corresponding exhaust valve, air, or only weakly-carburetted air, enters.

In this way, it is prevented that under low load conditions, a portion of the mixture of air and gasoline may be expelled from the combustion chamber to the engine exhaust; moreover, an improvement is additionally obtained of the combustion, under all operating conditions, due to the turbulence effect, and the consequent stirring up of the charge inside the combustion chamber, due to the air stream which enters in advance through a valve, and has assumed a certain speed, and a whirling behaviour when it comes to interfere with the heavily carburetted air stream which subsequently enters through the other valve.

Characteristics and advantages of the invention are now illustrated by referring to the hereto attached FIGS. 1–3, wherein for exemplifying, non-limitative purposes, a preferred form of practical embodiment of the same invention is depicted.

Figure 1:
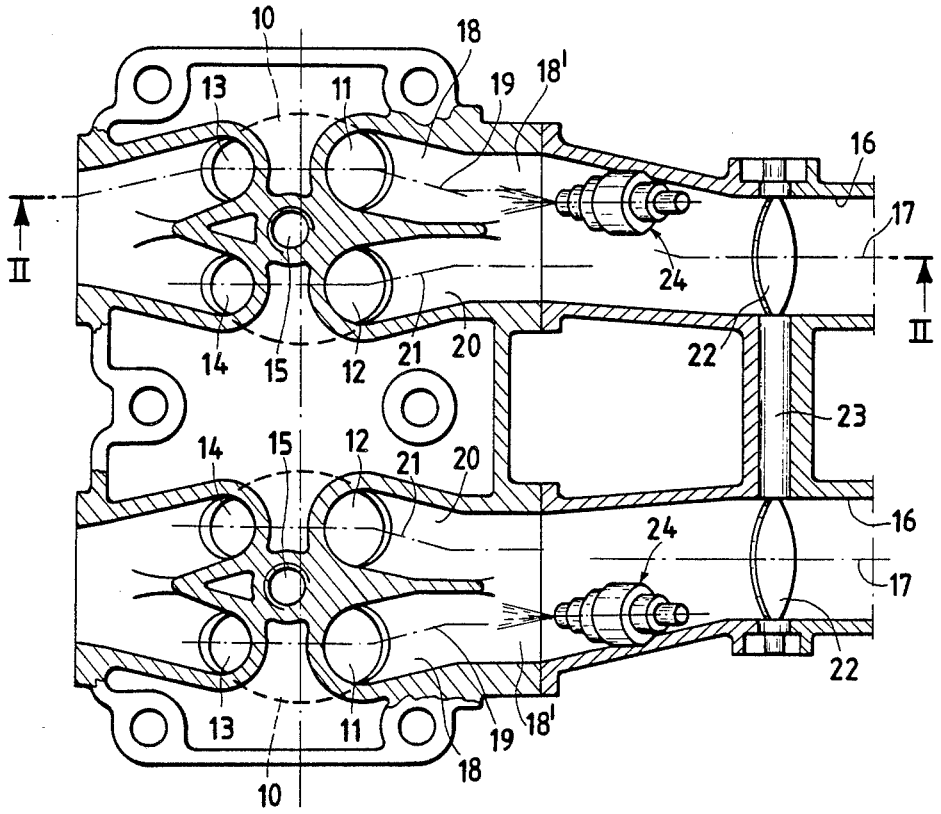
FIG. 1 shows a sectional view of an induction device according to the present invention.
Figure 2:
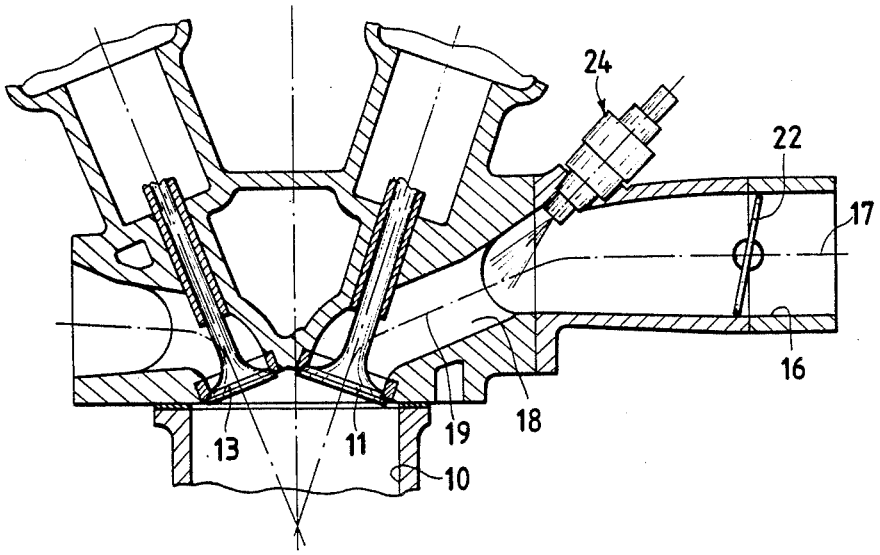
FIG. 2 shows a partially sectional view along the path plane II—II of FIG. 1.

In FIGS. 1 and 2, a diagram is shown of an internal combustion engine equipped with four valves per cylinder; by the reference numeral 10, two cylinders are indicated, by the reference numerals 11 and 12 the respective induction valves, by 13 and 14 the respective exhaust valves, by 15 the spark plugs are indicated.

By the reference numeral 16, the individual induction manifolds of each cylinder 10, and by 18 and 20 two ducts are indicated, which branch off from the relevant manifold 16, and lead to the combustion chamber of the same cylinder through the valves 11 and 12.

By the reference numerals 17, 19, 21, the respective longitudinal axes of the manifold 16 and of the ducts 18 and 20, are indicated.

Inside each manifold 16, a relevant choke valve, for choking the feed, indicated by the reference numeral 22, is installed; the choke valves 22 are connected with each other by a diagrammatically represented shaft 23, and are operatively linked with the accelerator pedal, not shown in the figures, as usual in the art.

Inside each manifold 16, downstream the relevant choke valve 22, an electroinjector, generally indicated by the reference numeral 24, is installed.

Each electroinjector 24 is mounted off-centre relatively to the longitudinal axis 17 of the relevant manifold 16, i.e., shifted towards the side of the duct 18.

The electroinjector 24 can also be mounted coaxial with the axis 19 of the duct 18.

Advantageously, as it results from FIGS. 1 and 2, the induction duct 18 with which the injector 24 is associated, has a first portion 18' having its axis substantially parallel to the axis of the manifold 16 from which the duct 18 branches off, and a second portion having its axis 19 forming an angle with said axis substantially parallel to the axis of the manifold 16; the axis of the electroinjector 24 and the axis of the first portion 18' of the induction duct 18 are on a same plane, and the electroinjector 24 is located with its axis being skew relatively to the axis of the second portion of the induction duct 18.

The induction valves 11 and 12 and the exhaust valves 13 and 14 are operatively connected with respective cam shafts, not shown in the figures, constituting the driving means for these valves.

Figure 3:
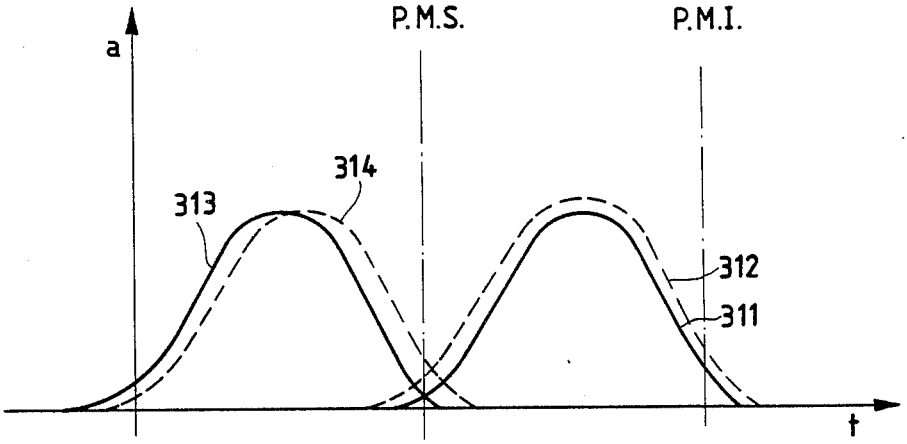
FIG. 3 shows charts of the lift laws of the valves of the engine of the invention.

In the particular case herein depicted, it is provided for the induction valves 11 to be operated by cams having a lift law (a) so computed as to obtain high torques, low consumption rates and reduced emissions of polluting substances under partial-load operating conditions, e.g., such a law as shown in FIG. 3 by the curve 311.

As regards the induction valves 12, they are operated by means of cams with a lift law (a), so computed as to increase the peak power of the engine, e.g., such as that shown in FIG. 3 by the curve 312.

In FIG. 3, also the curves 313 and 314 are shown, which represent the lift laws (a) of the exhaust valves 13 and 14.

As it results from FIG. 3, the opening stroke of the valve 11 is narrower than of the valve 12, with the starting of valve 11 opening being delayed relatively to that of the valve 12, relatively to the top dead centre (TDC), and the crossing (i.e., the simultaneous opening astride the TDC) of the induction valves 11 and exhaust valves 13 is minimum, whilst the crossing of the induction valves 12 and exhaust valves 14 is wide.

The induction stroke of a cylinder 10 begins with the opening of the relevant valve 12; through it, a stream of air only, or of weakly carburetted air enters, which assumes a whirling movement with a rather high speed, having a lower specific gravity than the airgasoline mixture.

Then, the valve 11 opens, and through it a stream of strongly carburetted air enters, because all of the fuel delivered by the electroinjector 24 during the injection stroke, or most of it, enters the duct 18.

The meeting of the two streams, one of which has already assumed a whirling movement, and a certain speed, causes an effect of turbulence and of stirring up of the charge, which renders more homogeneous said charge, owing to the better fuel distribution in the air, and favours the complete combustion thereof, under all engine operating conditions.

Furthermore, the rich-in-fuel mixture is prevented from passing unburnt to the exhaust port, because the crossing between the induction valves 11 and the exhaust valves 13 is small, whilst the crossing between the induction valve 12, which is concerned by an only air stream, and the exhaust valve 14, is wide.

We claim:

1. Induction device for a multi-cylinder internal combustion engine equipped with a plurality of induction valves, and at least one exhaust valve per each cylinder, in particular with two induction valves (11, 12) per cylinder, and equipped with driving means for said valves, wherein said induction device comprises individual induction manifolds (16), one induction manifold per each cylinder (10), and at least two induction ducts (18, 20) branching off from each individual manifold (16) and leading to the corresponding cylinder (10) through the above-said induction valves (11, 12), and wherein the two induction valves of each cylinder are driven with lift laws respectively optimized for the low-revolution-speed running conditions and the high-revolution-speed running conditions of the engine, characterized in that a respective choke valve (22) is installed inside each induction manifold (16) in a per se known way, and that at least one fuel injector (24) is installed inside each individual induction manifold (16), downstream the respective choke valve (22), in an off-centre position relatively to the longitudinal axis (17) of the same manifold (16), and shifted towards the side of the induction duct (18) equipped with the induction valve (11) having a lift law optimized for the low-revolution-speed operating conditions.

2. Device according to claim 1, characterized in that the induction duct (18) with which the injector (24) is associated has a first portion (18') having an axis substantially parallel to the axis of the manifold (16) from which the duct (18) branches off, and a second portion having its axis (19) forming an angle with said axis substantially parallel to the axis of the manifold (16).

3. Device according to claim 2, characterized in that the axis of the injector (24) and the axis of said first portion (18') of the induction duct (18) are on a same plane.

4. Device according to claim 2, characterized in that the injector (24) is located with its axis being skew relatively to the axis of said second portion of said induction duct (18).

* * * * *